US005553788A

United States Patent [19]

Del Gaone et al.

[11] Patent Number: 5,553,788

[45] **Date of Patent: *Sep. 10, 1996**

[54] SPRAY GUN ASSEMBLY AND SYSTEM FOR FLUENT MATERIALS

[75] Inventors: Peter V. Del Gaone, Drexel Hill, Pa.; Walter Dany, Riverdale, N.J.; R. Paul Rossi, Jr., San Carlos, Calif.; Ronald R. Scotchmur, Schiller Park; Ernest F. Watts, Riverside, both of Ill.

[73] Assignee: Binks Manufacturing Company, Franklin Park, Ill.

[ * ] Notice: The term of this patent shall not extend beyond the expiration date of Pat. No. 5,370,315.

[21] Appl. No.: 323,154

[22] Filed: Oct. 14, 1994

Related U.S. Application Data

[63] Continuation-in-part of Ser. No. 138,473, Oct. 15, 1993, Pat. No. 5,370,315.

[51] Int. Cl.[6] ..... B05B 7/02; B05B 1/28

[52] U.S. Cl. ..... 239/527; 239/290; 239/124; 239/583

[58] Field of Search ..... 239/124, 125, 239/526, 527, 583, 290, 528, 413–415, 407, 429, 433; 222/380; 137/872, 625.48

[56] References Cited

U.S. PATENT DOCUMENTS

| | | | |
|---|---|---|---|
| 2,345,402 | 3/1944 | Lubbock et al. | 239/125 |
| 2,550,888 | 5/1951 | Traughber, Jr. | 137/607 |
| 2,613,997 | 10/1952 | Ball | 239/125 |
| 2,880,976 | 4/1959 | True . | |
| 2,971,700 | 2/1961 | Peeps | 239/296 |
| 3,018,968 | 1/1962 | Levey | 239/124 |
| 3,119,531 | 1/1964 | Jacobs | 222/318 |
| 3,123,306 | 3/1964 | Bradley | 239/142 |
| 3,123,307 | 3/1964 | Bradley | 239/336 |
| 3,179,341 | 4/1965 | Plos et al. | 239/414 |
| 3,187,956 | 6/1965 | Dawson . | |
| 3,277,868 | 10/1966 | Lockwood et al. . | |
| 3,306,495 | 2/1967 | Wabers . | |
| 3,375,978 | 4/1968 | Rennie | 239/527 |
| 3,504,855 | 4/1970 | Volker | 239/125 |
| 3,587,970 | 6/1971 | Tindall | 239/125 |
| 3,589,610 | 6/1971 | Wahlin | 239/124 |
| 3,606,168 | 9/1971 | Seaman, Jr. . | |
| 3,819,116 | 6/1974 | Goodinge et al. | 239/125 |
| 3,858,761 | 1/1975 | O'Dell | 222/318 |
| 4,106,699 | 8/1978 | Holt | 239/124 |
| 4,124,045 | 11/1978 | Slywka | 222/318 |
| 4,200,207 | 4/1980 | Akers et al. | 222/318 |
| 4,341,329 | 7/1982 | Kuemmerer et al. | 222/380 |
| 4,535,919 | 8/1985 | Jameson | 239/124 |
| 4,875,625 | 10/1989 | Jones | 239/124 |
| 4,907,741 | 3/1990 | McIntyre | 239/583 |
| 5,078,322 | 1/1992 | Torntore | 239/527 |

OTHER PUBLICATIONS

Texspray System Manual, Graco, Inc., 1991.

*Primary Examiner*—Andres Kashnikow
*Assistant Examiner*—Lesley D. Morris
*Attorney, Agent, or Firm*—Dann, Dorfman, Herrell and Skillman, P.C.; Henry H. Skillman

[57] ABSTRACT

A spray gun for spraying fluent materials comprising a valve chamber, a nozzle connected to the chamber at one end thereof, inlet and outlet ports communicating with the valve chamber, and a valve element having a hollow interior displaceable in the chamber between closed and open positions. The valve element is operable in the closed position to extend between the inlet and the outlet ports to allow flow of material through the inlet into the hollow interior of the valve element and out through the outlet. The valve element in the open position is operable to split the flow through the inlet into: a first partial flow through the hollow interior of the valve element and out of the hollow interior and the valve chamber through the outlet; and a second partial flow through the spray nozzle, whereby the flow through the outlet is uninterrupted when the inlet is receiving the material under pressure.

52 Claims, 10 Drawing Sheets

SPRAY GUN ASSEMBLY AND SYSTEM FOR FLUENT MATERIALS

This is a continuation-in-part application of the application Ser. No. 08/138,473, filed Oct. 15, 1993, entitled SPRAY GUN FOR AGGREGATES, now U.S. Pat. No. 5,370,315.

FIELD OF THE INVENTION

The present invention relates to spray guns and particularly to spray guns adapted for spraying fluent materials which have a high viscosity and/or a concentration of particulates which may be fibrous and/or abrasive and/or aggregate materials; especially particulate-loaded cement or mortar, such as plaster or conventional stucco or synthetic stucco which is most commonly called exterior insulation finish systems (E.I.F.S.).

BACKGROUND OF THE INVENTION

It has been known that in order to provide an effective spray apparatus for materials with a high particulate content, it is necessary to provide means for maintaining a continuous circulation of the particulate-laden liquid both during the periods when the liquid is being sprayed and during intermediate periods when the spray is interrupted. A continuous circulation of liquid serves to maintain the particulate material in suspension within the carrier liquid.

Conventional valving arrangements have proven to be unsatisfactory for fluent materials in which the particulate material is highly abrasive.

Merely circulating particulate material in a suspension with a carrier liquid, is not, by itself, an answer to all of the problems encountered in spraying high particulate content fluent material. Large particulate material and solutions having particulate material with a wide range of particle size, such as fibers and other aggregate suspensions, not only plug orifices that are the same size or slightly larger than the large particulates, but these larger particulates also agglomerate in large openings impeding or actually blocking the opening, making it difficult, if not impossible, to use these fluent materials in a spray apparatus.

Another difficulty encountered with large particulate materials in suspension arises because the larger particulates tend to pack in, or agglomerate, in valve seats and other openings in a spray apparatus so that the opening or closing of apertures or valves becomes inefficient or even impossible after a short period of use.

In some instances, even where an effective spray apparatus has been provided which permits the continuous recirculation of fluent materials in order to maintain particulate material in suspension within the carrier liquid, that feature is not necessary for some solutions or suspensions, such as paint and the like which do not contain a significant quantity of particulate material. Continuous recirculation in these cases is inefficient, using substantially more energy and equipment, and subjects the spray apparatus to additional sources of leakage.

Accordingly, it would be of great advantage to the art if a spray apparatus could be convertible between a continuous recirculation device, which maintains particulate material in suspension within the carrier liquid and, in its alternative embodiment, a spray apparatus which provides for direct passage of the fluent material through the apparatus without recirculation.

The size of existing spray apparatus, and particularly existing spray guns, has been found to be a limitation as even larger particulate material is used in the particulate laden carrier liquid. The large sized particulate material has been found to require orifices or openings which are too large for conventional spray guns. It would be a great advance in the art if a valving arrangement could be provided which would permit the use of conventional sized spray guns while accommodating larger particulate material in suspension within the carrier liquid.

SUMMARY OF THE INVENTION

With the foregoing in mind, the present invention provides a novel spraying apparatus which has improved means affording recirculation of the spray liquid which avoids harmful effects from the presence of fibrous or abrasive particles in the spray liquid.

The apparatus of the present invention minimizes the opportunity for the particles of the liquid to lodge in the apparatus and interfere with the operation of the spray gun or cause deterioration of the same.

More specifically, the present invention provides a spraying apparatus having an improved valve construction which affords continuous circulation of spray liquid through the apparatus both when the apparatus is operating to spray the spray liquid and when the apparatus is operative to interrupt the spray of the spray liquid, and at all positions therebetween.

The valve of the present invention has a valve element which cooperates with the inlet for the spray material to provide a shearing action between the valve element and the valve chamber which is effective to disintegrate any particulate material which might lodge between the valve element and the chamber, thereby avoiding inadvertent interruption of the spaying operation.

The valve of the present invention provides facile incremental adjustment of the flow through the spray head for spray liquids having a wide variation in particle content, viscosity, and abrasiveness.

In its preferred embodiment, the present invention has been found to be highly effective in minimizing the effects of large particulate containing fluent materials. This is accomplished by providing an opening for the fluent material flow that is divided into partial flows for both spraying and for recirculation, wherein the size of each opening is at least about four times greater than the size of the largest particulate in the fluent material. In a most preferred embodiment, the inlet which is subjected to the valve element causing the partial flow in two directions, has an elliptical configuration or generally oval cross section with the longer portion aligned with the direction of displacement of the valve element. This elliptical configuration allows for larger openings without requiring the redesign of the rest of the spray gun.

It has also been found that substantially longer wear and less plugging of the spray gun is accomplished when the valve element is sized to fit in the chamber with a clearance less than the diameter of the smallest particulate in the fluent material. In order to deal with both extremely large and extremely small particulate matter, it is essential that the valve element be able to terminate the forward spray without difficulty. This is accomplished in the present invention by having the cooperative surfaces of the valve chamber and the valve element at the point where the valve element engages the chamber be sharp edges so that as the valve element is displaced to the closed position, the sharp edges cut or scrape the particulates out of that intersection point to permit effective closure.

In yet another preferred embodiment of the present invention, it has been found that the device can be converted to a non-recirculating spray gun. This is accomplished by providing a valve element that is sized to be positioned in the chamber both as previously positioned and also in the chamber after 180° rotation of the element. The valve element, on its diametrically opposed side presents a surface blocking flow through the inlet and the outlet in the closed position of the valve and permits flow only through the inlet and through the spray nozzle in the open position of the valve.

The present invention also provides an improved nozzle with an effective seal that allows improved mixing of the fluent material with the air. In addition, the nozzle can be replaced or changed while the spray gun is in the recirculating mode.

Finally, an alternative embodiment has been discovered which permits the use of a shorter spray gun by placing the inlet and outlet in a side by side tandem position generally perpendicular to the major axis of the gun causing recirculation to exit to the side rather than to the rear of the gun. This permits a shorter, more compact design while retaining all of the features of the present invention.

BRIEF DESCRIPTION OF THE DRAWINGS

All of the objectives of the present invention are more fully set forth hereinafter with reference to the accompanying drawings, wherein.

DESCRIPTION OF THE PREFERRED EMBODIMENTS

Figure 1:
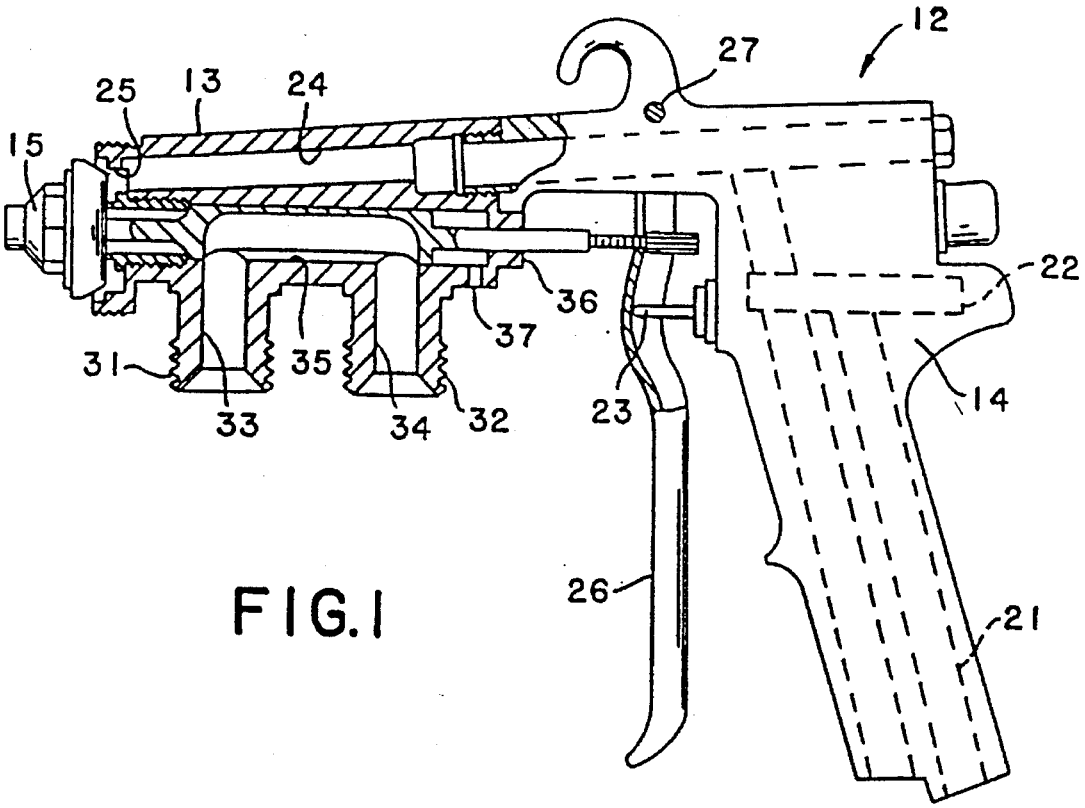
FIG. 1 is an elevational view of a spray gun embodying flow control apparatus for the spraying liquid in accordance with the present invention, the portions of the gun being broken away to illustrate the valve which is in its closed position.

FIG. 1 illustrates a spray gun embodying a flow control valve for the spray fluid made in accordance with the present invention. The gun is designed for dispensing a spray fluid in the form of a liquid aggregate. The spray gun 12 has a barrel 13 and a handle 14. At the distal end of the barrel 13, a spray nozzle 15 is mounted to discharge the spray fluid in a spray pattern of a selected design. In the present instance, the gun nozzle 15 incorporates peripheral air outlets at 17 which are designed to envelop the spray pattern with a discharge of compressed air. Compressed air is introduced into the nozzle through an air passage 21 and is controlled by a valve 22 having an operator 23 which is selectively operable to introduce compressed air into an air passage 24 in the barrel leading to an air plenum 25 surrounding the nozzle. Actuation of the operator 23 is achieved by trigger 26 pivoted to the barrel at 27 and operable to be pressed toward the handle by either two or four fingers of the operator. The foregoing components are standard operating components of a spray gun, and further description thereof is not deemed necessary.

In accordance with the present invention, means is provided to effect a continuous circulation of spray fluid through the spray gun. In the present instance, the gun is designed to accommodate a spray liquid having carrying particulate material having fibrous and/or abrasive components. To this end, the barrel 13 has an interior axial wall defining an elongated tubular bore forming a valve chamber 35. The barrel is provided with a first nipple 31 for the intake of the spray fluid and a second nipple 32 for the discharge of the spray fluid. In the present instance, the nipples 31 and 32 are positioned adjoining one another in close parallel relation, each nipple having an axial bore 33 or 34 opening into the axial wall of the valve chamber 35 which extends therebetween. The end of the valve chamber proximate the handle 14 is closed, for example by an end wall 36 and is vented as indicated at 37. The distal end of the valve chamber is provided with internal threads 38 to receive the nozzle 15 which has a threaded portion passing through the plenum 25 into engagement with the internal threads 38 of the valve chamber. The hollow interior 54 of the spray nozzle 15 communicates with the valve chamber 35 at its distal end.

Figure 2:
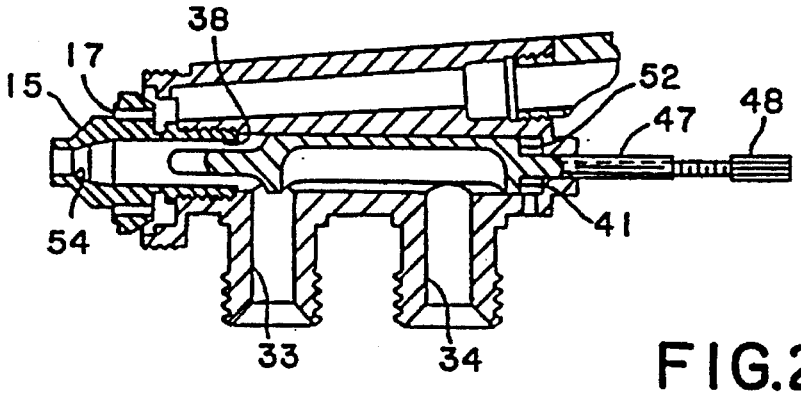
FIG. 2 is a fragmentary view of the gun shown in FIG. 1 showing the valve in its fully opened position.
Figure 3:
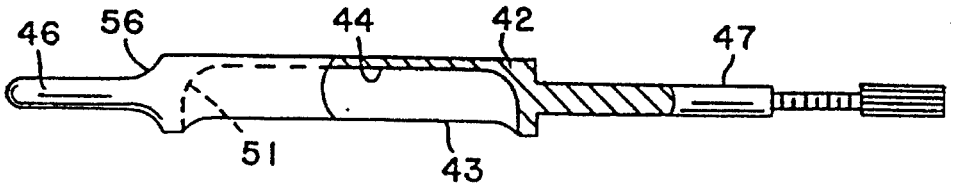
FIG. 3 is an enlarged view of the valve element with portions broken away to show its construction.

A shuttle valve element 41 is positioned for axial displacement in the chamber 35. As shown in FIG. 3, the valve element 41 has a hollow body shell 42. The outside of the hollow shell 42 has a sliding fit with the interior wall of the chamber 35 and has an opening 43 extending along the length of the bottom of the body so as to allow the hollow interior 44 of the body to communicate with the inner ends of the bores 33 and 34. At its forward end, the valve element 41 has a transverse forward partition 51 with a forwarding projecting nose portion 46 which extends into the interior 54 of the nozzle 15 as shown in FIG. 2. At its rear end, the valve element 41 has a transverse rear partition 52 and a rearwardly projecting stem 47 which passes through the end wall 36 and terminates in an operator 48 which is threadedly engaged in the stein 47. The operator is actuated by the trigger 26 by engaging in a slot within the trigger. Thus, as the trigger is operated to open the valve 22 through the operator 23, it also displaces the valve element 41 to the right. When the trigger is actuated, the air line to the passage 24 is opened at the same time as the valve element is moved to the right which effects communication between the inlet bore 33 and the hollow interior of the nozzle 15. When fully opened, as shown in FIG. 2, the front partition 51 (FIG. 3) is positioned across the middle of the bore 33 so as to divide the flow of the liquid aggregate approximately equally between the hollow interior 44 of the valve element and the hollow interior 54 of the nozzle. The projecting nose 46 of the valve element reduces the flow area through the hollow interior 54 of the nozzle 15, so as to maintain the desired velocity in the liquid discharged into the interior of the nozzle, thereby avoiding a reduction in velocity which might otherwise cause the particulate material in the flow to settle out and accumulate in the hollow interior 54 of the nozzle 15. It is noted that at the base of the nose portion 46, the cross section of the nose portion 46 flares smoothly as indicated at 56 into the outer perimeter of the forward partition 51 of the valve element 41 to provide a smooth forward-flow passage. Likewise, the hollow interior 44 of the valve merges into the back of the forward partition 51 and the front of the rear partition 52 to provide a smooth flow passage for the rearward flow. The flow passages through the bore 33, the interior of the shell and the bore 34 are all of approximately the same flow area and devoid of obstructions which could throttle or otherwise interfere with the recirculating flow therethrough.

The present design has been found to enable facile adjustment of the flow incrementally from and a pre-set minimum rearward flow at the fully open position one limit, and "zero" forward flow and maximum rearward flow at the closed position at the opposite limit. If it is desired to alter the proportion of flow at the fully opened position, the operator 48 may be adjusted relative to the stem 47. In any event, care must be exercised to ensure a sufficient proportioning of the rearward flow through the valve element and into the outlet to maintain a minimum flow through the spray liquid lines to the inlet 31 and outlet 32 when the valve is fully opened. By maintaining a predetermined minimum flow through the lines, it is possible to use lines of smaller diameter with the result that the volume of spray liquid in the lines is similarly reduced so as to reduce the overall weight of the spray gun during its use. Maintaining the pre-set minimum flow avoids clogging of the line which would be a problem if flow through the line were arrested when the nozzle is open.

Displacement of the valve element causes the partition 51 to sweep across the mouth of the bore 33 in the axial wall of the chamber 35. The outer perimeter of the partition provides sharp edges on opposite side which cooperate with the sharp outline of the mouth to provide a shearing action which severs or disintegrates any particulate matter which might tend to lodge between the valve element and the valve chamber wall across the mouth of the bore 33. This shearing action is particularly effective when the spray liquid carries fibrous particles, as is the case when the spray liquid is fiber-loaded cement or mortar. To achieve this shearing action, the clearance between the sharp edge of the partition the sharp outline of the mouth should be less than the thickness of the particles in the particulate material carried in the spray liquid.

Figure 4:
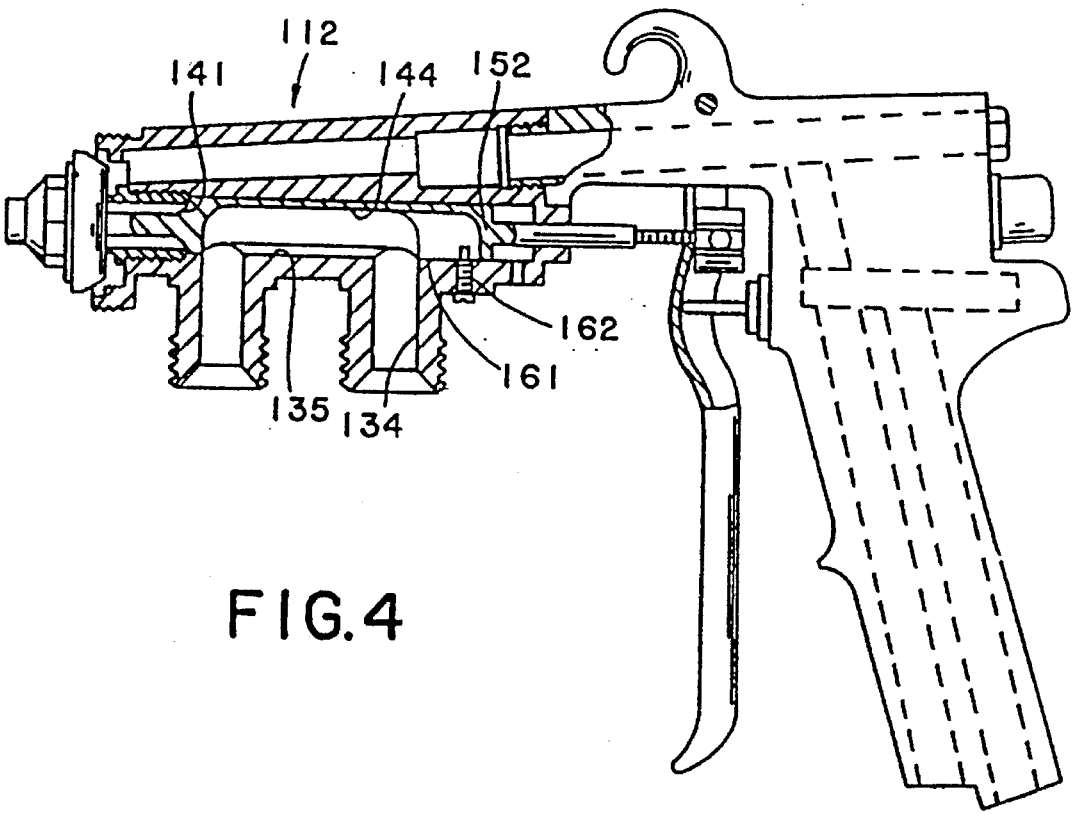
FIG. 4 is a view similar to FIG. 1 showing a modified spray gun having a second embodiment of a valve, the valve being shown in closed position.
Figure 5:
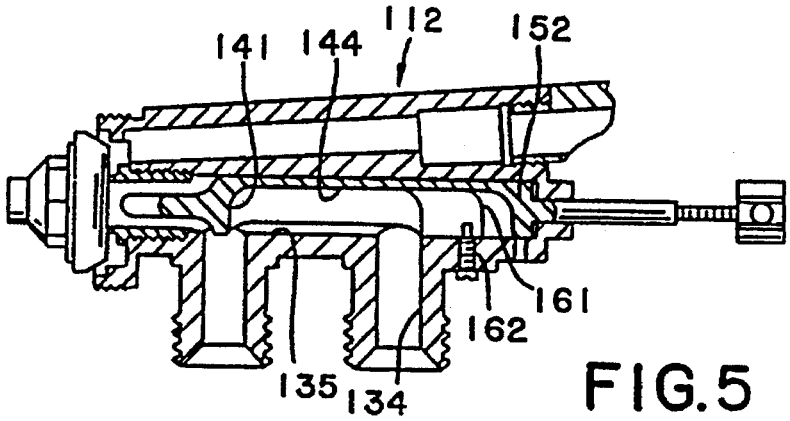
FIG. 5 is a fragmentary view of the gun shown in FIG. 4 with the valve in open position.
Figure 6:
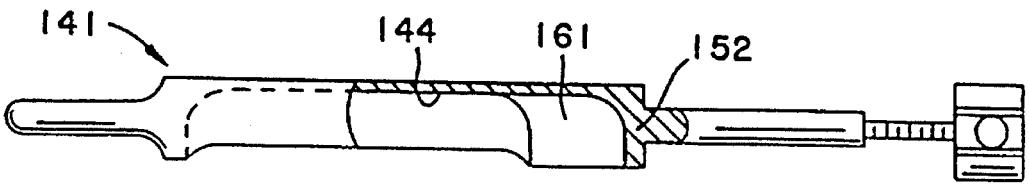
FIG. 6 is an elevational view of the valve element in FIG. 5 with portions broken away and showing the stator component of the gun in broken lines.

FIGS. 4, 5 and 6 illustrate an alternative construction which may be desired for use with the liquids having a high tendency to effect precipitation of particular matter. FIG. 4 illustrates a modified construction of a gun housing 112 in which the valve chamber 35 of the embodiment of FIG. 1 is modified as shown at 135 to accommodate a longer valve element 141. The hollow interior 144 of the valve element 141 is extended axially to the rear towards the handle to accommodate a stator plug 161 slidable within the hollow 144 of the valve element and which is fixed in position within the chamber 135 by a anchoring element 162. The stator plug 161 provides a transverse stator surface which is fixedly mounted in registry with the far side of the outlet bore 134, and allows the valve element 141 to be displaced towards the handle without leaving a pocket between the rear partition 152 of the valve element 141 and the rear edge of the port connecting the bore 134 of the outlet nipple with the chamber 135. It should be noted that in FIG. 2 there is a pocket formed when a rear wall 52 of the valve element is displaced to the open position. The stator surface is flared to merge into the interior surface of the shell forming the hollow interior 144.

In other respects, the valve element 141 is similar in function and construction to the valve element 41 of the embodiment in FIGS. 1–3.

Figure 7:
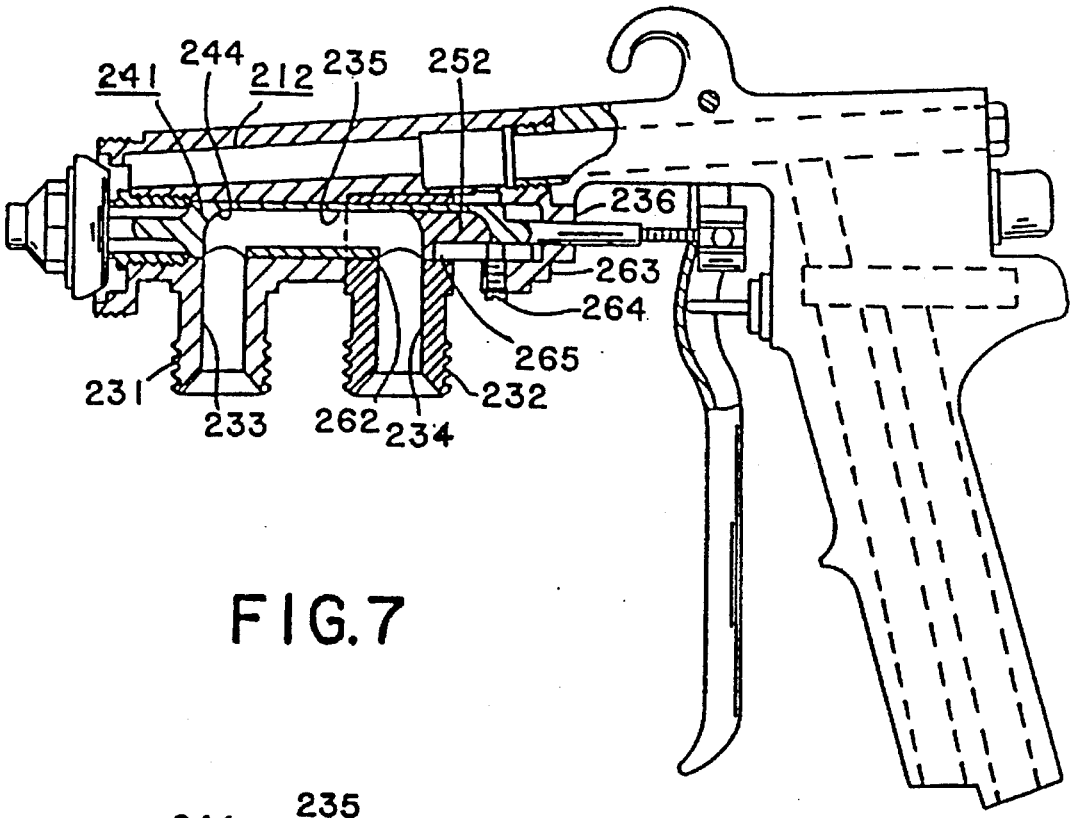
FIG. 7 is a view similar to FIG. 4 of a further embodiment of a spray gun embodying the present invention with the valve in closed position.
Figure 8:
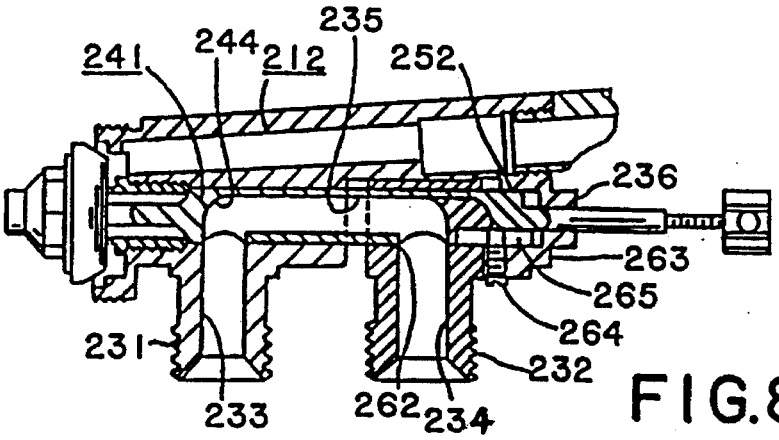
FIG. 8 is a fragmentary view of the apparatus shown in FIG. 7 with the valve in open position.
Figure 9:
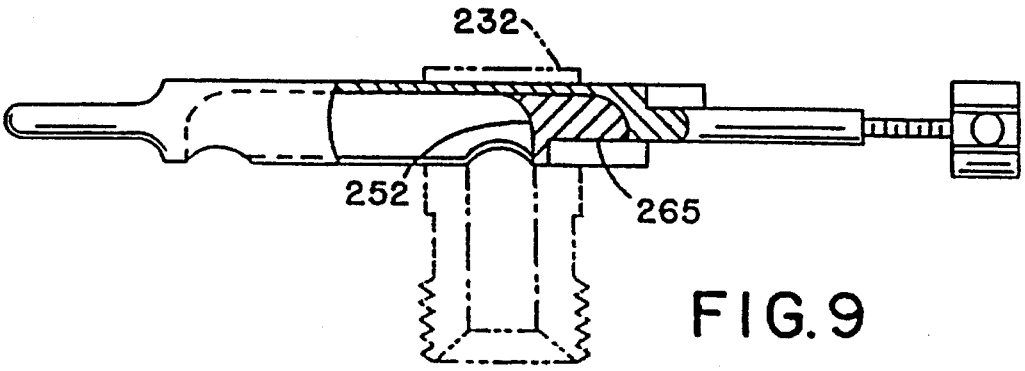
FIG. 9 is a view of the valve element with portions broken away and showing the movable return outlet in dot-and-dash lines.

FIGS. 7–9 illustrate another embodiment of the invention which avoids the formation of a pocket in the flow path for the recirculating material. To this end, FIG. 7 illustrates a modified construction embodying a valve element 241 similar in configuration and function to the elements 41 and 141. In this embodiment of the invention, a spray gun housing 212 is provided with a fixed inlet nipple 231 having an inlet bore 233 and a movable outlet nipple 232 having an outlet bore 234. The movable outlet nipple 232 is mounted on the modified valve element 241 to register with the interior surface of the rear partition 252 of the hollow 244 of the valve element. In the present instance, the nipple 232 is removably mounted on the valve element with seals 262 and a set screw (not shown). Thus, as the valve is displaced between its closed and open positions, the nipple 232 moves with the valve element 241 as shown in FIGS. 7 and 8. The contoured surface rear partition 252 is fixed in alignment with the bore 234 to provide a smooth flow passage for the recirculating liquid aggregate. To provide a sliding support for the proximate handle end of the valve element, the end wall 236 of the valve chamber 235 is provided with a bottom support 263 having an upstanding guide element 264 adapted to engage in a guideway 265 in the handle end of the valve element. The guide 264 and guideway 265 restrict rotation of the valve element 241 as it is actuated between its open and closed positions. As with the valve element 141, the element 241 is similar in configuration and function to the valve element 41.

It is noted that the hollow interior of the valve element in all three embodiments of the present invention provides a smooth flow passage which is approximately equal in flow area to the flow passages provided through the bores of the inlet and outlet nipples. The transverse inner walls of the partitions at the opposite ends of the valve element merge into the interior axial wall of the hollow with a gradual flare as shown. In this way, the valve element avoids any substantial throttling or disruption of the flow of the spray liquid introduced through the inlet nipple, enabling the spray liquid to be pumped to and through the spray gun at the desired flow rate without being substantially affected by opening and closing the valve.

The guns illustrated in the drawings are suitable for spraying liquid aggregates which have a relatively high viscosity and/or a high particle content. The spray liquid flows through the valve chamber and the nozzle without excessive leakage or infiltration of the spray liquid into the operating parts of the gun. For aggregates with discrete particles, it has been found that the clearance between the valve element and the valve chamber wall should be less than the size of the particles, so that when the valve element is at rest, the particles serve to block the flow of the spray aggregate through the clearance spaces in the assembly. As the valve element moves, the confronting edges disintegrate the particles by a shearing action. The enlarged clearances facilitate the cleansing of the spray apparatus at the end of the day, when the apparatus is flushed with water or another cleaning liquid. For lighter liquids having a greater ability to penetrate clearance spaces, it may be desirable to provide additional sealing components in the form of auxiliary seals or in the form of leak-resisting coatings or materials for the movable components.

Figure 10:
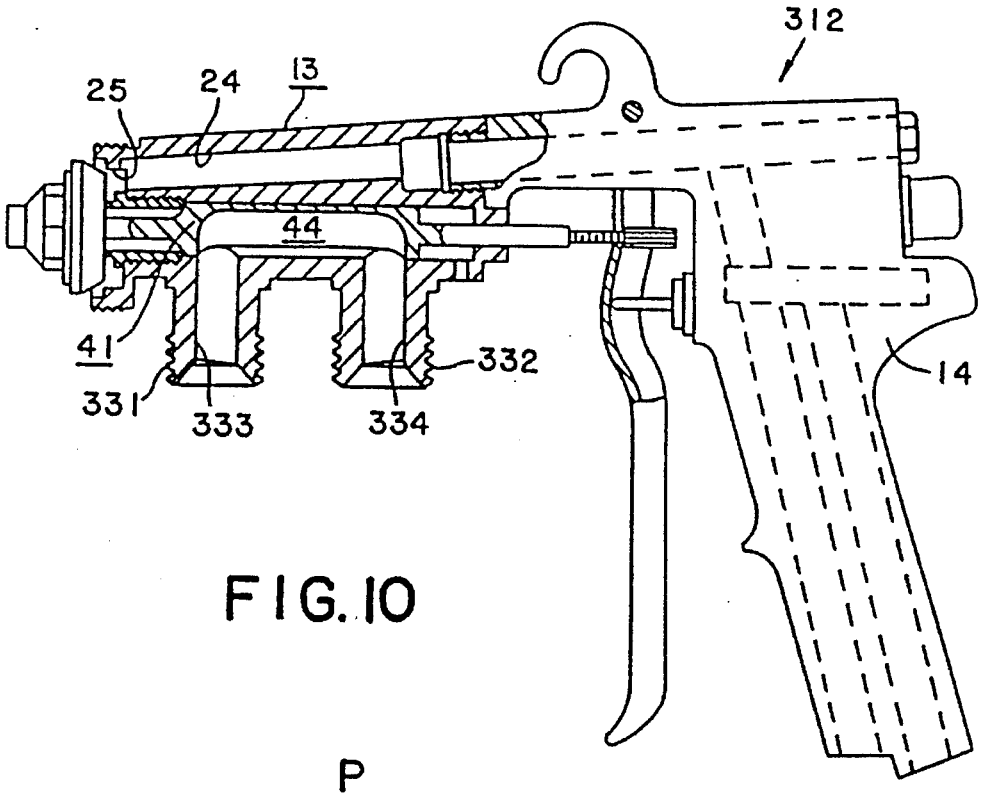
FIG. 10 is a view similar to FIG. 1, but showing the spray gun having modified inlet and outlet fluid ports of elliptical configuration.
Figure 11:
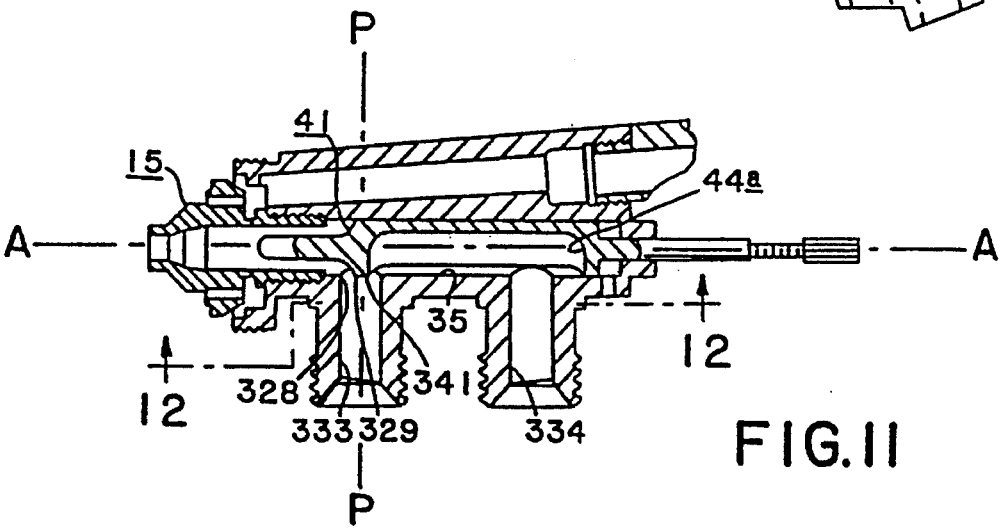
FIG. 11 is an enlarged fragmentary, sectional, elevational view of the gun head shown in FIG. 10, illustrating the elliptical fluid inlet and outlet ports in relation to the actuated position of the fluid return valve.
Figure 12:
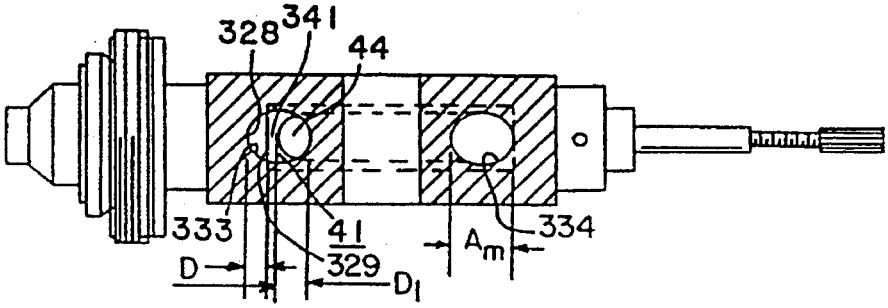
FIG. 12 is a sectional, bottom plan view taken along the stepped line 12, 12 of FIG. 11, showing the elliptically shaped inlet and outlet fluid ports with respect to the return valve in an actuated position.

FIGS. 10–12, inclusive illustrate another embodiment of the present invention generally similar to that shown at FIGS. 1–9 described above. The elements of this embodiment which are the same as the previously described embodiment bear the same reference numerals. New or modified parts are given new reference numbers in the 300 series.

The spray gun generally designated by the numeral 312 includes a barrel or body portion 13 formed from an aluminum alloy having a handle 14 depending from one end thereof, a valve chamber 35, and a valve element 41 slideably mounted in the valve chamber between open and closed positions. The spray gun 312 also includes inlet and outlet fittings communicating with the valve chamber 35 which are externally threaded to attach flexible lines for connection to a fluent material supply source. The valve element 41 is generally biased to a closed position by a spring biased trigger 26 whereby fluent material is recirculated in a closed loop including the hollow interior 44 in the valve element 41 which defines a recirculation passageway or chamber. When the trigger 26 is retracted to displace the valve element 41 rearwardly to the open position (FIG. 11), a portion of the fluent material is directed to the discharge nozzle 15 and a portion is recirculated. Note that in this position the front wall of the valve element is located approximately at the midpoint of the inlet opening 333.

The fluent materials including particulates or aggregates of various sizes or fibers require a flow area of a predetermined minimum size in order to prevent so-called plugging in the spray gun and recirculating system by obstructing or closing the flow areas. In the present instance, a critical flow area is in the region where the flow of the fluent material at the inlet 333 is split when the valve element 41 is in the open position. Accordingly, in order to minimize the possibility of plugging in this split flow area, the inlet and outlet openings 333 and 334 are of non-circular cross section adjacent the valve chamber 35. Preferably, the openings are oval shaped with the major axis $A_m$ aligned with the axis A—A of the valve chamber 35. Further, the distance D between a transverse plane P—P through the sharp edge 329 on the front face of the valve element divider 341 is spaced at least about four times the diameter of the largest particulate in the fluent material. Note also in FIG. 11 that the back edge of the partition 341 is likewise spaced a predetermined distance $D_1$ at least about four times the size of the largest particulate.

It is noted that the interaction of the sharp edge 329 of partition or divider 341 and sharp edge 328 of valve chamber 35 operate to scrape or dislodge any particulate material and shear any fiber, during actuation of the valve element 41 to a closed position to permit full closing of the valve element 41. It is also noted that the non-circular or oval shaped configuration of the inlet and outlet port provides the desired increased flow area in critical flow areas to eliminate the possibility of plugging without requiring an increase in the size of the gun in a width-wise direction. Circular openings of a comparable size increase the dimensions and size of other components of the gun thereby adding weight, decreasing maneuverability and increasing cost of manufacture.

There is illustrated in FIGS. 13–17 inclusive, another embodiment of spray gun in accordance with the present invention. The major elements of the gun are generally similar to the previously described embodiments. The elements of this embodiment which are the same as the previously described embodiment bear the same reference numerals. New or modified parts are given new reference numbers in the 400 series.

Figure 13:
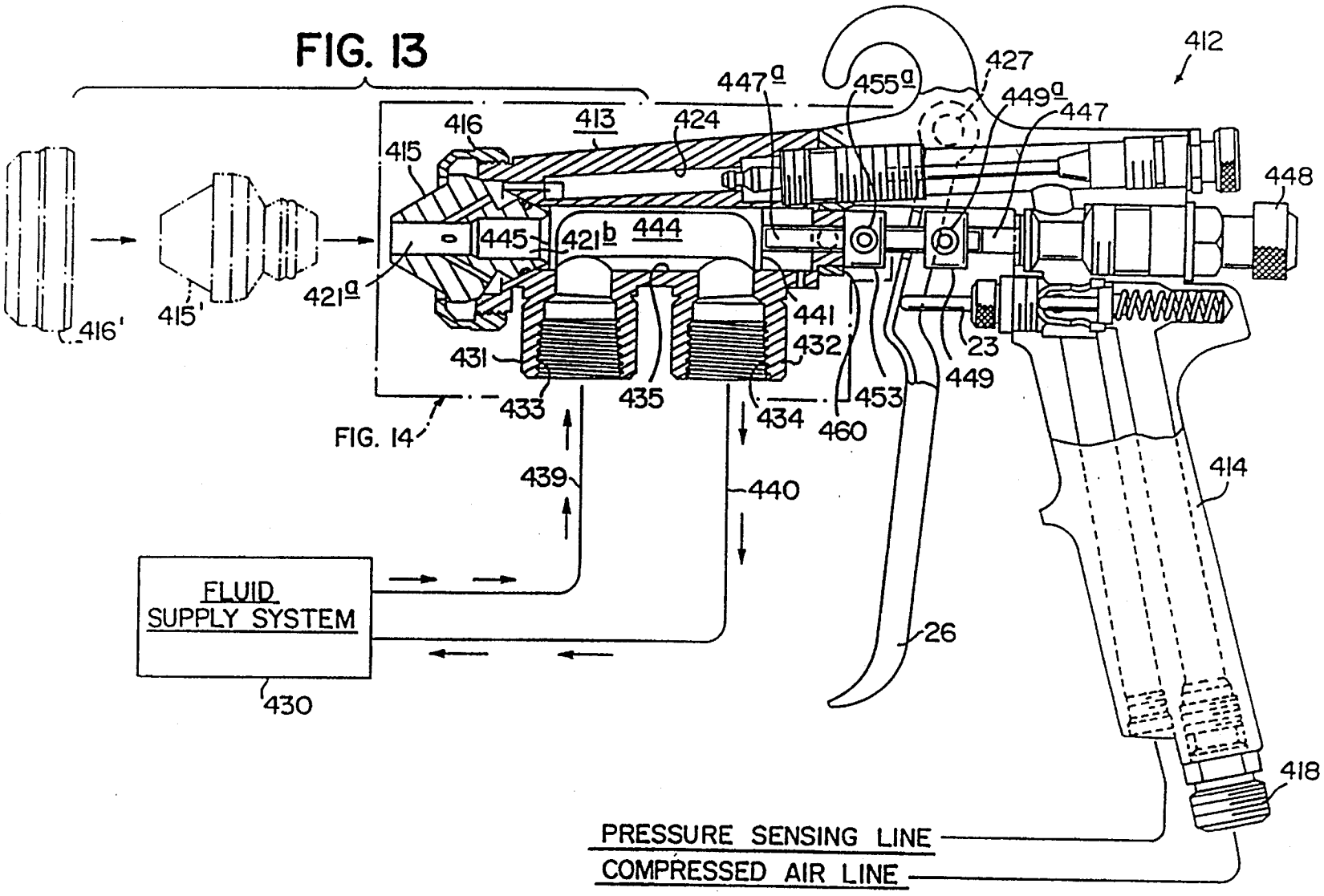
FIG. 13 is an enlarged side elevational view of a modified spray gun with portions broken away and in section, illustrating details of the modified spray gun.
Figure 14:
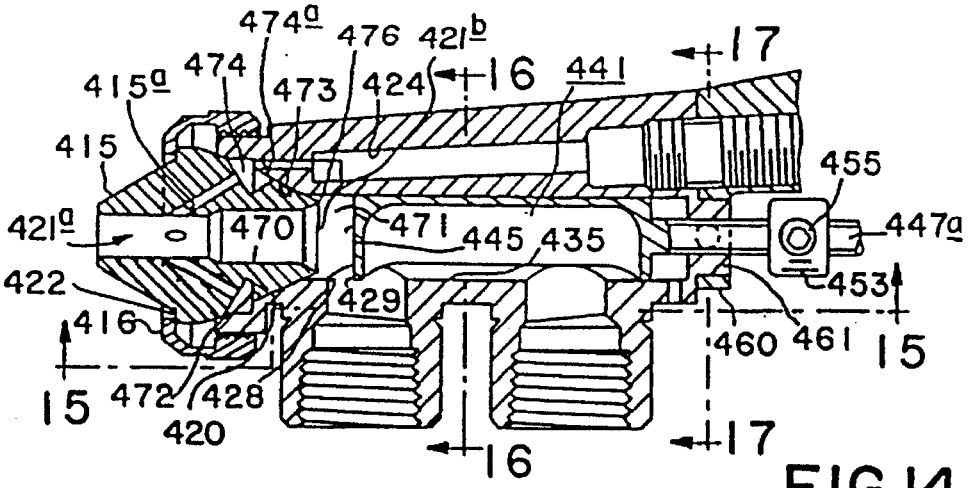
FIG. 14 is an enlarged, fragmentary elevational view of the details contained within the dot and dash box of FIG. 13 which is designated FIG. 14.
Figure 15:
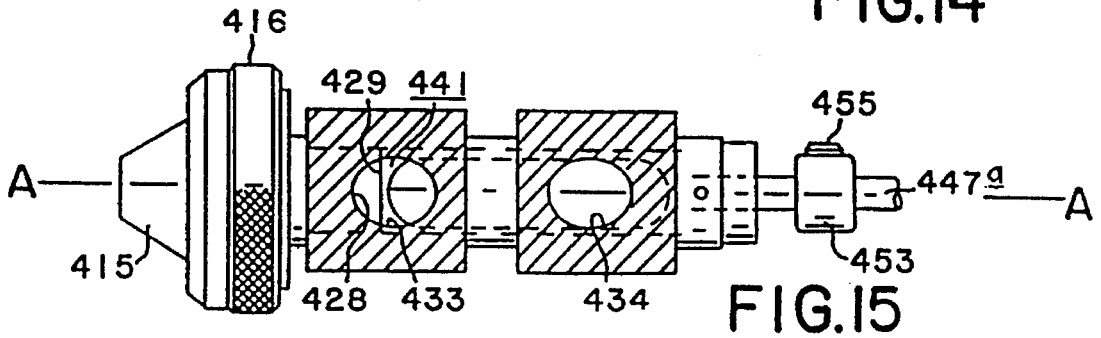
FIG. 15 is a bottom sectional plan view taken along the stepped line 15, 15 of FIG. 14, showing the elliptical fluid inlet and outlet ports and the equal area relationship of the fluid inlet port to the actuated position of the valve.
Figure 16:
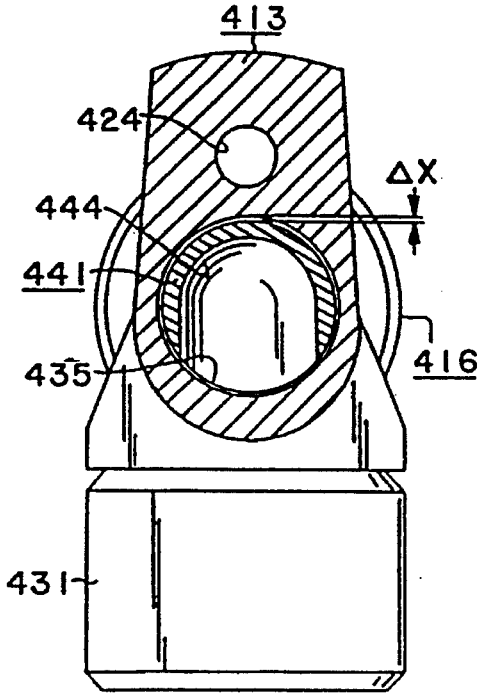
FIG. 16 is an enlarged sectional elevational view taken along the line 16, 16 of FIG. 14, showing cross sectional details of the valve and its dimensional designed clearance in its housing to allow fluid only floating of the return valve body.
Figure 17:
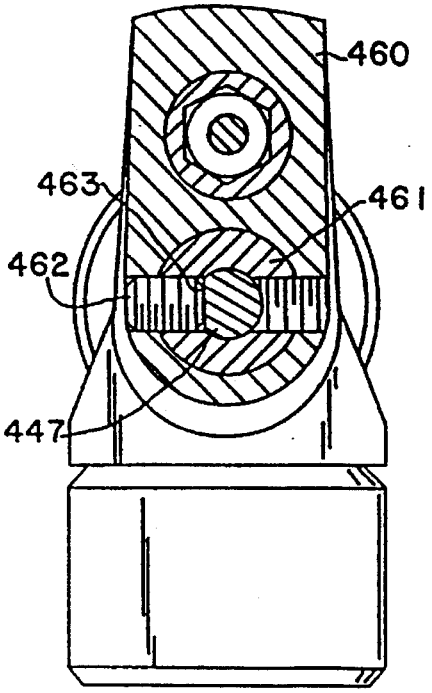
FIG. 17 is an enlarged sectional view taken along the line 17, 17 of FIG. 14, showing the means by which the return value body cavity is maintained in vertical alignment with the fluid inlet and outlet ports.

Thus the spray gun generally designated by the numeral 412 includes a gun head or body 413 and a handle 414 depending from one end of the gun head 413. Fluent materials from a fluid supply source 430 are delivered under pressure through line 439 to inlet fitting 431 and inlet port 433 through recirculation chamber 444 in valve element 441 through outlet opening 434. When valve element 441 is retracted to an open position to discharge fluent materials by actuating trigger 26 rearwardly toward the handle 414 to position the valve element 441 and parts as shown in FIG. 14, pressurized air is delivered to the nozzle 415 through passageways in the spray gun to discharge fluent material in a pattern of desired texture. More specifically, the valve element 441 has a valve stem 447$^a$ projecting from its rear face which mounts a pair of adjustable collars 449 and 453 which straddle the trigger 26 in the manner shown in FIG. 13. A spacer pin 447 (FIG. 13) abuts valve stem 447$^a$ and is disposed between the valve stem 447$^a$ and fluid control assembly 448 which has an internal adjustable stop for selectively determining the open position of the valve element 441. The collars 453 and 449 are adjustable axially relative to valve stem 447$^a$ and held in a desired orientation by set screws 455 and 449$^a$. The collar 453 is positioned on valve stem 447$^a$ to abut shoulder 460 when the valve element 441 is in the closed position as shown in FIG. 13. Accordingly, even when the fluent supply system recirculates fluent material, the nozzle 415 can be removed if desired and replaced, for example, with a different nozzle to change spray pattern. As noted the fluent control assembly 448 determines the open limit position for the valve element 441.

In accordance with this embodiment of the invention, the inlet and outlet openings 433 and 434 are also of non-circular cross section, preferably oval shaped having a major axis aligned with the axis A—A of the valve chamber 435 to provide the desired flow area in the open position of the valve, that is at least about a 4 to 1 ratio to the largest particulate in the fluent material being processed. Further, in the present instance, the valve element 441 has a planar front axial end face 445 defining a sharp circumferentially extending edge 429 which cooperates with the sharp edge 428 of the valve chamber 435 to provide the shearing and dislodging action of fiber and particulate in the fluent material and prevent plugging when the valve is actuated from open to closed positions.

The radial clearance $\Delta x$ (FIG. 16) between the valve element 441 and the valve chamber 435 is preferably smaller than the smallest particulate in the fluent material, preferably not greater than 0.001 inches. In other words, the diameter of the valve element 441 is about 0.002 inches smaller than the diameter of the valve chamber 435. By this relationship, the carrier liquid in the fluent material will function as a lubricant in the interface between the valve element 441 and valve chamber 435 while preventing ingress of the smallest particulate matter in the fluent material. In accordance with this embodiment of the invention, the nozzle 415 is characterized by novel features of constructions and arrangement facilitating easy and quick change over when it is desired to vary the spray pattern of the fluent material. The nozzle 415 also has a configuration which cooperates with the valve element 441 to ensure a relatively tight sealed relationship between the parts when the valve element 441 is in a closed position. Thus, the nozzle comprises a body portion having a stepped axial bore 470 extending therethrough having an outer discharge end 421$^a$ and having an inner end 421$^b$ confronting a chamber 471 (FIG. 14) in front of the axial end face of the valve element 441. The outer peripheral surface of the front end of the nozzle 415 is tapered or of frustro conical shape. The rear portion likewise has a tapered outer peripheral surface 472 which complements the shape of the tapered valve seat 420 which it engages in the assembled relation. The juncture of the front and back of the nozzle is defined by a radially outwardly directed, circumferentially extending shoulder 422 engagable by a cap 416 which threadedly engages complementary threads on the front end of the gun to seat the nozzle 415. The nozzle 415 may be removed and replaced by removing the cap 416 as indicated in broken lines at 415' and 416' in FIG. 13.

The inner end of the bore which extends inwardly from its discharge end 421$^a$ is beveled to define a sharp circumferentially extending edge 476 which abuts the planar end face 445 of the valve element 441 in the closed position as illustrated in FIG. 13. An O-ring 473 engaging in a groove in the tapered rear face 472 of the nozzle provides a seal at the interface with the tapered valve seat 420. The tapered rear face 472 has a peripheral circumferentially extending cut out defining a circumferential manifold 474 in fluid communication with pressurized air supply port 474*a* to deliver pressurized air to the axial bore 421 in the nozzle through angled circumferentially extending connecting ports 415*a*. As in the previous embodiment, the interaction of sharp edge 476 and planar end face 445 operate to shear or dislodge any fiber or particulate material during activation of the valve dement 441 to a closed position to permit full closing of the valve element 441.

Figure 18A:
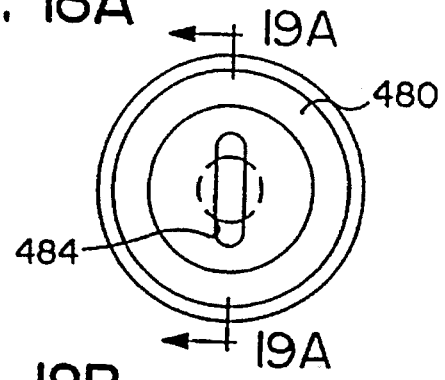
FIGS. 18A–18D are enlarged front elevational views of four interchangeable nozzles that may be used with the spray gun shown in FIG. 13.
Figure 19A:
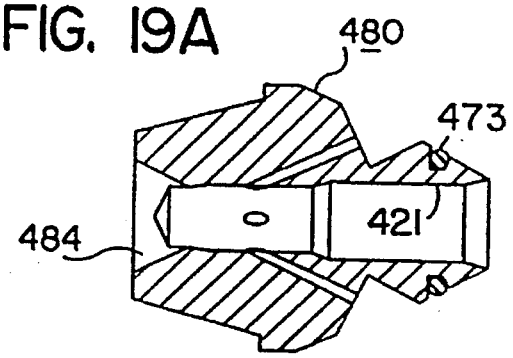
FIGS. 19A–19D are sectional, elevational views of each of the nozzles shown in FIGS. 18A–18D, respectively, along the respective lines 19A, 19A through 19D, 19D.
Figure 18B:
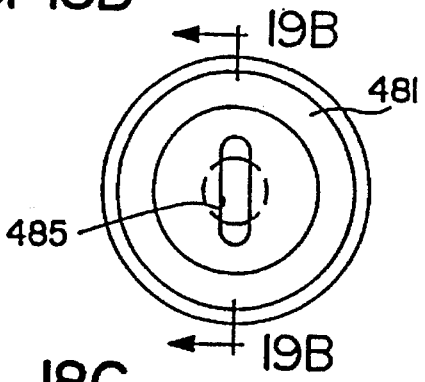
Figure 19B:
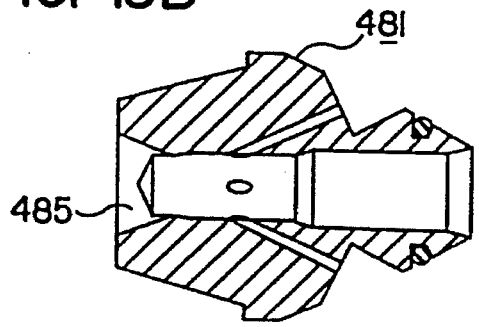
Figure 18C:
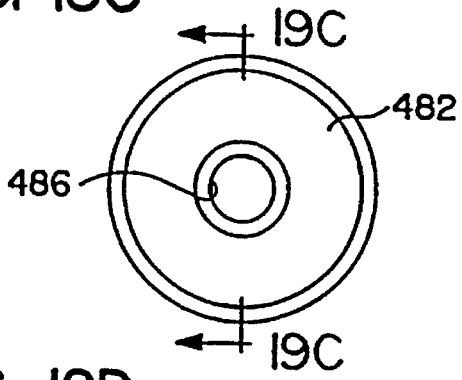
Figure 19C:
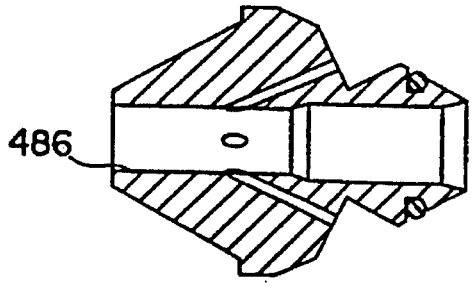
Figure 18D:
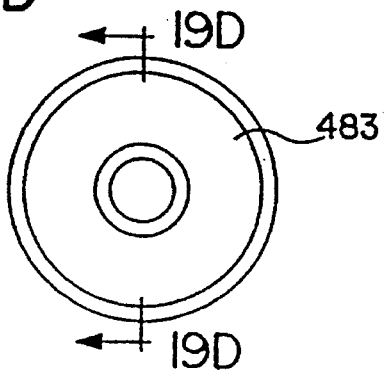
Figure 19D:
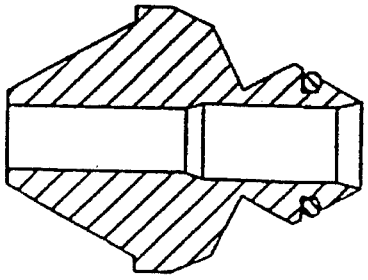
Figure 20:
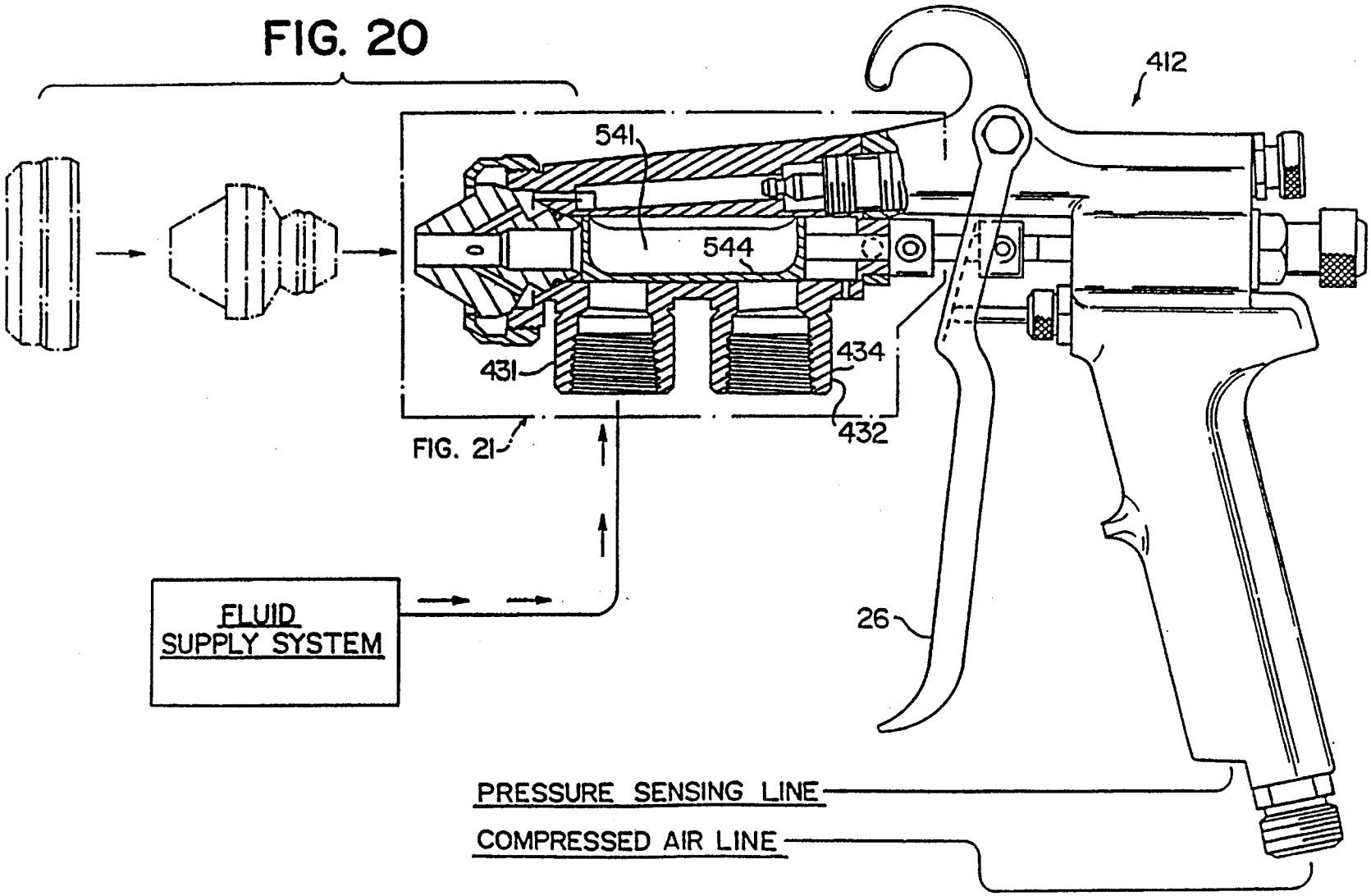
FIG. 20 is a side elevational view of another modification, illustrating the spray gun of FIG. 13, having been converted to a so-called "dead-end" spray gun utilizing only the fluid inlet port with no return port opening.

FIGS. 18Aa–19D inclusive, show various nozzle embodiments in accordance with the present invention facilitating different spray patterns and use with different fluent materials. Accordingly, in the embodiment illustrated in FIGS. 18A and 19A, the discharge end 484 nozzle 480 has an axial bore 421 whose is outwardly flared at an included angle of about 45° and is oval shaped in cross section. In the embodiment shown in FIGS. 18B and 19B, a nozzle 481 has a bore whose discharge end 485 is likewise outwardly flared at an included angle of about 30° and is oval shaped in cross sections similar to the previously described embodiment. The nozzle 482 shown in FIGS. 18C and 19C is the same general configuration as the nozzle 415 described in connection with FIG. 13 spray gun embodiment of the invention, having a stepped bore 486. The nozzle 483 shown in FIGS. 18D and 19D does not have the angularly disposed air distribution ports or holes and is adapted for use with cementitious material which are poured rather than sprayed.

FIGS. 20–24, inclusive show another embodiment of the spray gun in accordance with the present invention. The elements of this embodiment which are the same as the previously described embodiment bear the same reference numerals. New or modified parts are given new reference numbers in the 500 series.

This embodiment of spray gun is useful for spraying highly aggregated fiber filled paints and other fluent materials which have a long pot life. In other words these fluent materials do not set or settle out if properly maintained. With these materials there is no need for a continuous recirculating system.

Figure 21:
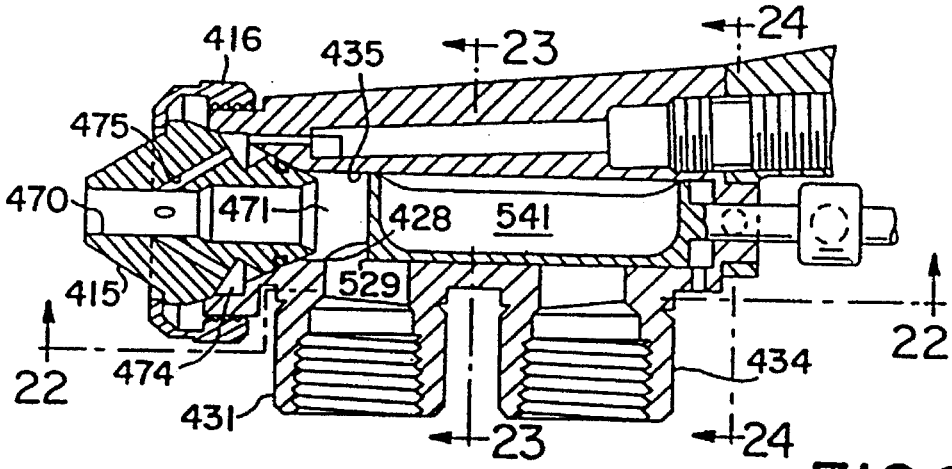
FIG. 21 is an enlarged fragmentary sectional elevational view of the detail contained within the dot and dash box of FIG. 20 and designated as FIG. 21.
Figure 22:
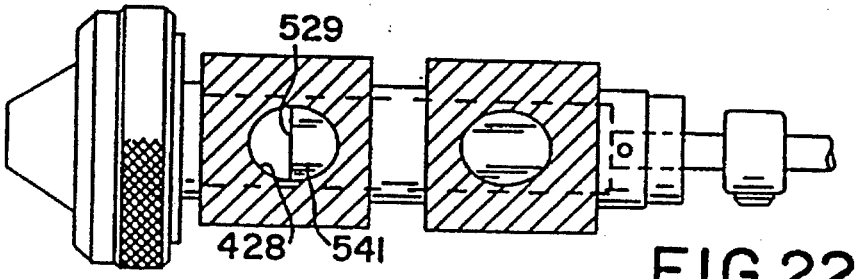
FIG. 22 is a bottom plan sectional view taken along the stepped line 22, 22 of FIG. 21.
Figure 23:
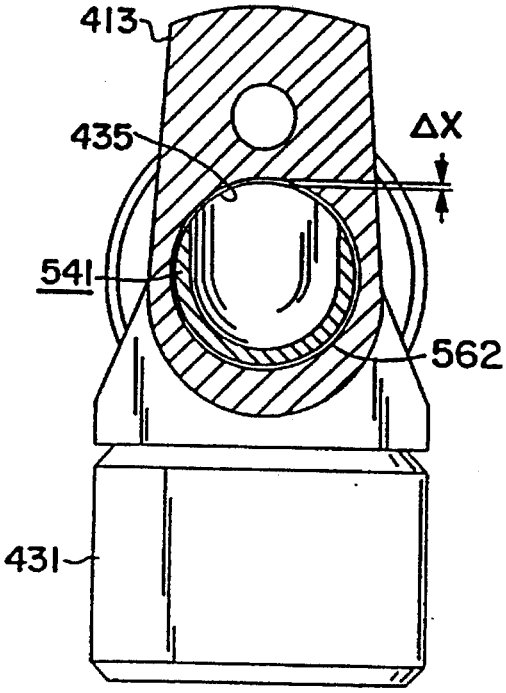
FIG. 23 is an enlarged transverse sectional elevational view taken along the line 23, 23 of FIG. 21 showing the return valve in an inverted position.
Figure 24:
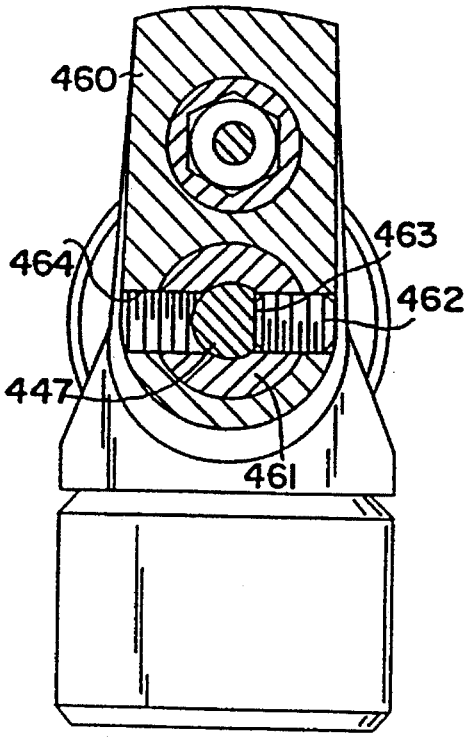
FIG. 24 is an enlarged transverse sectional elevational view taken along the line 24, 24 of FIG. 21, shown the means by which the return valve is maintained in an inverted position and vertically aligned with the fluid inlet and outlet parts.

In this embodiment, the valve element 541 is simply rotated 180° to present the closed wall 544 of the valve element to the inlet and outlet openings 433 and 434 in the nipples 431 and 432. (See FIGS. 20 and 23). The valve stem 447 has a flat 463 on one face thereof and the shoulder 460 has threaded bores 464 on either side of the opening through which the valve stem 447 passes so that the set screw 462 can position the valve element 541 in two positions rather easily. Accordingly, as illustrated in FIG. 21, when the valve is actuated to an open position, all of the fluent material is directed past the leading edge 529 to the axial bore 470 of the nozzle 415 and is discharged in a spray pattern in the manner described previously.

Figure 25:
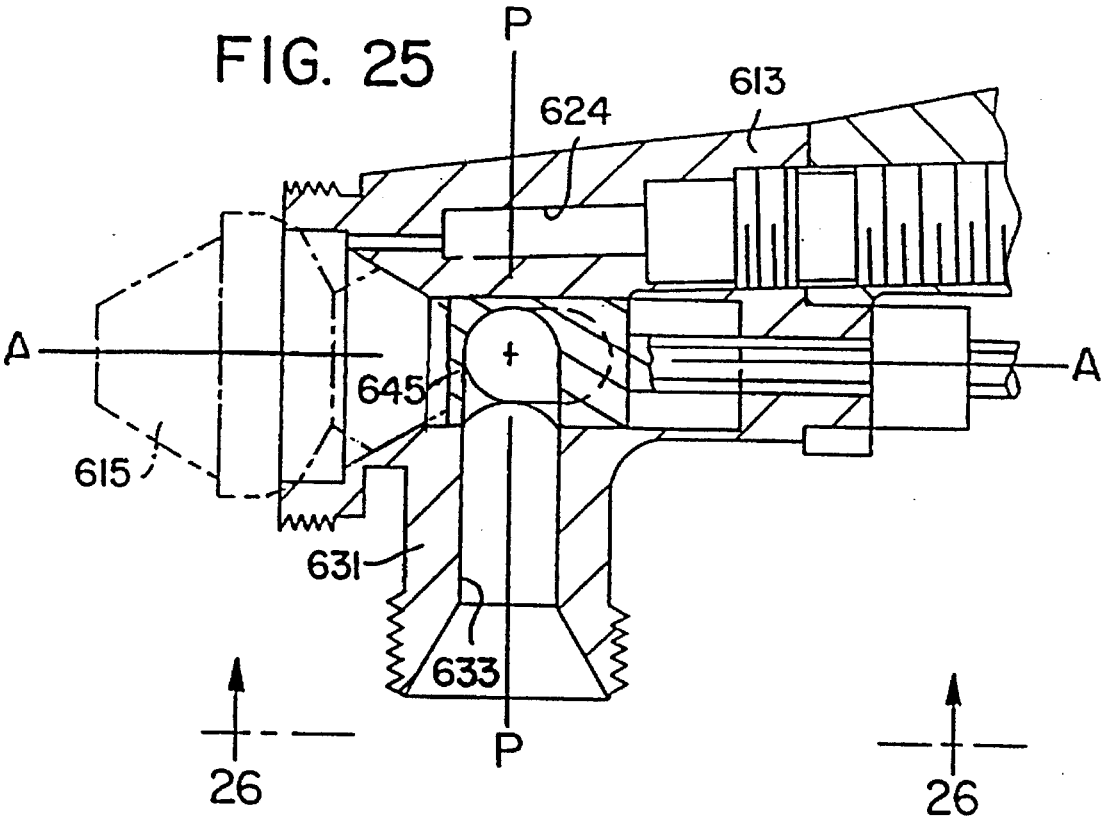
FIG. 25 as seen from the line 26—26 but showing the spray gun being modified to place the outlet fluid port to the side rather than to the back of the spray gun, the nozzle being shown in broken lines.
Figure 26:
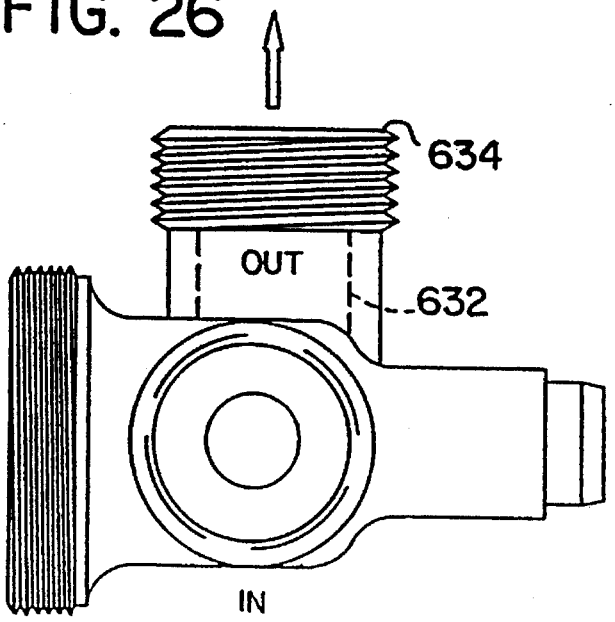
FIG. 26 is a view of the inlet and outlet ports as seen from the line 26—26 in FIG. 25, disassembled from the spray gun and shown rotated 90°.

FIGS. 25 and 26 show still another modified embodiment of the spray gun in accordance with the present invention. The elements of this embodiment which are the same as the previously described embodiment bear the same reference numerals. New or modified parts are given new reference numbers in the 600 series.

The basic elements of the gun including the nozzle 615 are generally similar to that described previously. However in the present instance, there is a novel arrangement of the inlet and outlet ports 633, 634, respectively, to provide a more compact overall design. More specifically, in the present instance, the inlet port 633 and the outlet port 634 are in angularly disposed nipples 631 and 632 projecting from a barrel 613, and are generally aligned in a common plane P—P extending transversely to the axis A—A of the valve chamber 635. The inlet and outlet ports 633, 634, respectively are circumferentially spaced apart, in the present instance 90°. In the illustrated embodiment, the axes of the parts intersect. There is a valve element 645 having a valve stem 647$^a$ slidable in the barrel 613, and an air passage 624 leads to the nozzle 615. The cut-out or chamber in the valve element 645 is significantly smaller in the axial direction. Accordingly, when the valve element 641 is in a closed position (FIG. 25), fluent material entering the inlet 633 passes directly and freely to the outlet port 634 and the gun is in a recirculating mode. When the valve element 645 is displaced rearwardly to an open position positioning front partition of valve element 645 midway of the inlet port 633, a portion of the fluent material is directed to the nozzle 615 and the remaining portion is directed to the outlet port 634 as in the previously described embodiments.

Even though the inlet and outlet ports 633, 634, respectively may be of various cross sectional configurations, a preferred arrangement is an inlet port 633 of circular cross section and outlet port 634 of oval shaped cross section.

Further, in the open position, outlet port 634 is flush with the rearward wall of the valve chamber and thus presents no pocket, or eddy allowing accumulation of aggregate in the chamber behind outlet port 634 which would inhibit closing valve element 641.

Even though particular embodiments of the present invention have been illustrated and described herein, it is not intended to limit the invention and changes and modifications may be made therein within the scope of the following claims.

What is claimed is:

1. A spray gun for spraying fluent materials comprising:

a valve chamber;

a nozzle connected to said chamber at one end thereof;

inlet and outlet ports communicating with said valve chamber;

a valve element having a hollow interior displaceable in said chamber between closed and open positions;

said valve element operable in the closed position to extend between said inlet and said outlet ports; said inlet and said outlet ports affording flow of material through said inlet port into said hollow interior of the valve element and out through said outlet port; and said valve element in the open position operable to split the flow through said inlet port into a first partial flow through said hollow interior of said valve element and out through said outlet port, and a second partial flow through said nozzle, whereby the flow through said outlet port is uninterrupted when said inlet port is receiving the materials under pressure.

2. A spray gun as claimed in claim 1, wherein the inlet and outlet ports adjacent said chamber are of non-circular cross section having a greater dimension in an axial direction of said chamber than in a direction transverse to said axial direction.

3. A spray gun as claimed in claim 2, wherein said inlet and outlet ports are oval shaped.

4. A spray gun as claimed in claim 1, wherein clearance between the valve element and chambers is in a range of about 0.002 inches.

5. A spray gun as claimed in claim 1, wherein said valve element has an axial end face confronting the nozzle, at least a portion of said axial end face being planar, and wherein the nozzle has a sharp peripheral edge adapted to abut the planar portion of the axial end face of said valve element when said valve element is in the closed position.

6. A spray gun as claimed in claim 1, wherein one axial end of said chamber has a conical outwardly tapered seat portion and said nozzle has a complementary frustoconical portion for engaging said seat.

7. A spray gun as in claim 6 further comprising a resilient sealing means in between said frustoconical portion of said nozzle and said tapered seat portion of said chamber.

8. A spray gun as claimed in claim 1, wherein the inlet and outlet ports are axially spaced apart.

9. A spray gun as claimed in claim 1, wherein said inlet and outlet ports are generally aligned in a common plane extending transversely to said chamber and the axis of said inlet port intersects the axis of said outlet port.

10. A spray gun as claimed in claim 1 wherein the nozzle includes an axial bore, a circumferentially extending manifold generally concentric to said axial bore, and a plurality of circumferentially spaced angularly directed radial ports extending from said bore to said manifold, and means to cause air to flow through said manifold and said radial ports into said bore.

11. A spray gun as claimed in claim 10 wherein an axial bore in said nozzle adjacent an outer tip thereof is flared outwardly and is of oval shaped cross section.

12. A spray gun as claimed in claim 10, wherein an axial bore in said nozzle is flared outwardly adjacent a discharge end and is of circular cross section.

13. A spray gun as claimed in claim 1, wherein said nozzle is a unitary, one piece construction including an axial bore formed therein for passing fluent materials.

14. A spray gun as claimed in claim 1, wherein clearance between a front axial end face of said valve element and said inner peripheral edge of said nozzle when in said open position is at least about four times the size of the largest particulate in the fluent materials.

15. A spray gun as claimed in claim 1, wherein clearance between said valve element and said chamber is less than the size of a smallest particulate in the fluent materials.

16. A spray gun as claimed in claim 1, wherein means is provided for mounting the valve element in the chamber so that it may be selectively positioned with the hollow interior formed in the valve element defining a recirculating chamber facing downwardly in communication with said inlet and outlet ports and rotated to a position wherein the valve element blocks the inlet and outlet ports in the closed position of the valve element.

17. A spray gun as claimed in claim 1, wherein said valve element is adjustable incrementally from said closed position to a fully open position, in said fully open position said flow being apportioned approximately equally between the hollow interior of the valve element and the nozzle.

18. A spray gun as claimed in claim 1, wherein said valve chamber has an interior axial wall defining an elongated tubular bore within the body of said gun, said inlet port into said interior wall, said valve element having a front transverse partition at one axial end of said hollow interior with an outline conforming to and slidable within said tubular bore between a closed position at the nozzle side of said inlet port and an open position intersecting said inlet port, whereby in said open position said front partition apportions the flow through said inlet port between the hollow interior of the valve element and said nozzle.

19. A spray gun as claimed in claim 18, wherein the spray inlet port is defined by a mouth having a sharp outline, and a perimeter of said front partition has sharp edges on its opposite sides which cooperate with the sharp outline of the mouth to provide a shearing action upon displacement of said valve element from the open position toward the closed position.

20. A spray gun as claimed in claim 19, for spraying fluent materials with a particulate content comprising particles having a thickness greater than a given dimension, the valve element providing a clearance space between said sharp edges and sharp outline which is no greater than said given dimension, whereby displacement of said valve element produces a shearing action disintegrating particles which may be positioned between either of said sharp edges and said sharp outline.

21. A spray gun as claimed in claim 20, wherein said clearance space is sufficiently large to allow a cleansing liquid to flow therethrough when the gun is flushed.

22. A spray gun as claimed in claim 18, wherein said front partition of said valve element has a nose projecting away from the hollow interior of the valve element, in the closed position, said nose being positioned within the interior of said spray nozzle and operable to be retracted upon displacement of said valve element toward said open position.

23. A spray gun as claimed in claim 18, wherein said outlet port is in said interior axial wall and is in communication with the hollow interior of said valve element continually as said valve element is displaced axially of said tubular bore between the closed position and the open position.

24. A spray gun as claimed in claim 23, wherein the valve element has an axial peripheral shell, said gun including a transverse stator surface fixedly mounted relative to said outlet port within said hollow interior, said transverse fixed surface having a flare merging into an axial interior surface of the shell of said valve element.

25. A spray gun as claimed in claim 18, wherein the valve element has a peripheral shell and a rear transverse partition at an opposite axial end of said hollow interior of the valve element, inwardly-facing surfaces of said front and rear transverse partitions being flared into the peripheral shell of said hollow interior so as to provide a streamlined flow path for fluent materials flowing through said hollow interior.

26. A spray gun as claimed in claim 1, wherein said valve element has a valve stem extending rearwardly out of said valve chamber, said stem having an operator for displacing the valve element, said spray gun including a trigger cooperable with said operator to displace said valve element incrementally between said closed and open positions.

27. A spray gun as claimed in claim 26, including means to adjust said operator relative to said stem, whereby the fully open position of said valve element is adjustable.

28. A spray gun as claimed in claim 26, wherein said spray gun includes means to supply compressed air to said nozzle and an air valve controlling the flow of the compressed air, said air valve having an operator coupled to said trigger whereby said compressed air is supplied to said nozzle concurrently with the displacement of said valve element to the open position.

29. A spray gun as claimed in claim 1, wherein said valve element includes a nose projecting toward said nozzle effective to reduce flow area through said valve chamber to said nozzle for maintaining the velocity of the fluent materials during passage from said inlet port to said nozzle.

30. A spray gun as claimed in claim 1, wherein flow passages of said valve inlet port, of said hollow interior of the valve element, and of said outlet port all provide a substantially equal flow area.

31. A spray gun as claimed in claim 1, for spraying fluent materials with a particulate content comprising particles having a thickness greater than a given dimension, said valve element having a clearance space within said valve chamber which is no greater than said given dimension and being displaceably mounted in said chamber without seals or packings.

32. A spray gun as in claim 1, wherein said valve element may be rotated to a position where said hollow interior of said valve element is not in fluid communication with said inlet port.

33. A nozzle for a spray gun having a tapered seat, a circumferentially extending manifold for delivering air under pressure to said nozzle, a valve chamber adjacent the seat, and a valve element in the chamber and actuatable between open and closed positions, the valve element having a flat planar surface on at least a portion of an axial end face confronting the seat, comprising:

a body portion having an axial bore for communicating at one end with the chamber and forming a discharge end at its opposite end;

a tapered inner portion engagable with the tapered seat and terminating in a sharp circumferentially extending edge for engaging the planar face of the valve element in the closed position; and a plurality of circumferentially spaced ports communicating at inner ends with the axial bore and for communicating at outer ends with the manifold.

34. A valve element for a spray gun having an elongated valve chamber formed therein, a nozzle at one end of the chamber, and inlets and outlets communicating with the chamber forming part of a pathway for delivering fluent materials to the spray gun;

said valve element slidable in said chamber between a closed position and at least one open position, having an end wall forming a flat planar surface on at least a portion of the axial end face for confronting the nozzle, and side walls forming an arcuate cut-out defining a recirculating passageway when the valve element is in said closed position, when in said open position, said side walls and said planar surface of said end wall splitting flow through the inlet between flow through said passageway and flow through the chamber to the nozzle.

35. In a system for spraying fluent materials;

a fluid supply system for delivering fluent materials to a spray gun under pressure;

a spray gun having inlet and outlet ports forming a closed circuit with said fluid supply system and opening into a valve element chamber in said spray gun;

a valve element mounted in said chamber operable between open and closed positions and having formed therein a cut-out defining a recirculating passageway to direct fluent materials in a closed loop when the valve element is in a closed position and permit discharge of a portion of the materials through a nozzle mounted at one end of the valve element chamber.

36. In a system for spraying fluent materials;

a fluid supply system for circulating fluent materials to and from a spray gun, a spray gun having a nozzle, inlet and outlet ports, and a valve chamber between said ports;

a valve element mounted in said valve chamber operable between opened and closed positions, said valve element having a recirculating passageway for uninterrupted flow of fluent materials from said inlet to said outlet, and when in said open position, splitting flow between said recirculating passageway and said nozzle.

37. A spray gun for spraying fluent materials which have a high concentration of abrasive component and/or embodying a high particulate content, said gun comprising:

a valve chamber, a spray nozzle connected to said chamber at one end thereof, a fluent material outlet at the other end of said chamber, and an inlet intermediate said nozzle and said outlet for receiving said fluent material under pressure;

a valve element displaceable in said chamber between a closed and an open position, said valve element having a hollow interior operable in the closed position to extend between said inlet and said outlet, said hollow interior being in fluid communication with both said inlet and said outlet, said inlet and said outlet and said hollow interior of the valve element each having a flow passage affording flow of said fluent material through said inlet into said hollow interior of the valve element and out through said outlet;

said valve element in the open position operable to split the flow through said inlet into a first partial flow through the hollow interior of the valve element and out through said outlet, and a second partial flow through the spray nozzle, whereby the flow through said outlet is uninterrupted when said inlet is receiving said fluent material under pressure.

38. A spray gun according to claim 37 wherein said valve element is adjustable incrementally from said closed position to a fully open position, said valve element in said fully open position apportioning said flow approximately equally between the hollow interior of the valve element and the spray nozzle.

39. A spray gun according to claim 37 wherein said valve element has a valve stem extending rearwaraly out of said valve chamber, said stem having an operator for displacing the valve element, said spray gun including a trigger cooperable with said operator to displace said valve incrementally between said closed and open positions.

40. A spray gun according to claim 39 including means to adjust said operator relative to said stem, whereby the open position of said valve element is adjustable.

41. A spray gun according to claim 39 wherein the spray gun includes means to supply compressed air to said spray nozzle and an air valve for controlling flow of the compressed air, said air valve having an operator coupled to said trigger whereby said compressed air is supplied to said nozzle concurrently with the displacement of said valve element to the open position.

42. A spray gun according to claim 37 wherein said valve element includes a nose extending along the length of said chamber operable to project into said spray nozzle and effective to reduce the flow area through said valve chamber between said valve element and said nozzle for maintaining the velocity of fluent material during its passage from said inlet to said nozzle.

43. A spray gun for spraying fluent materials which have a high concentration of abrasive components and/or embodying a high particulate content, said gun comprising:

a valve chamber, a spray nozzle connected to said chamber at one end thereof, a fluent material outlet at the other end of said chamber, and an inlet intermediate said nozzle and said outlet for receiving said fluent material under pressure;

a valve element displaceable in said chamber between a closed and an open position, said valve element having a hollow interior operable in the closed position to extend between said inlet and said outlet and being in fluid communication with both said inlet and said outlet, said inlet and said outlet and said hollow interior of the valve element each having a flow passage affording flow of said fluent material through said inlet into said hollow interior of the valve element and out through said outlet;

said valve chamber having an interior axial wall defining an elongated tubular bore within the body of the gun, said inlet providing a fluent material inlet opening into said interior wall, said valve element having a front transverse partition at one axial end of said hollow interior with an outline conforming to and slidable within said tubular bore between a closed position at the nozzle side of said fluent material inlet opening and an open position intersecting said fluent material inlet opening, whereby in said open position said front partition apportions of the flow of said fluent material through said fluent material inlet opening between a first partial flow through said hollow interior of the valve element and through said outlet of the chamber, and a second partial flow through said spray nozzle, whereby the flow through said outlet is uninterrupted when said inlet is receiving the spray material under pressure.

44. A spray gun according to claim 43 wherein said fluent material inlet opening is defined by a mouth having a sharp outline, and the perimeter of said front partition has sharp edges on its opposite sides which cooperate with the sharp outline of the mouth to provide a shearing action upon displacement of said valve element from the open position towards the closed position.

45. A spray gun according to claim 44, wherein said particulate content comprises particles having a thickness greater than a given dimension, and the valve element provides a clearance space between said sharp edges and said sharp outline which is no greater than said given dimension, whereby displacement of said valve element produces a shearing action disintegrating the particles which may be positioned between either of said sharp edges and said sharp outline.

46. A spray gun according to claim 45 wherein said clearance space is sufficiently large to allow a cleaning liquid to flow therethrough when the gun is flushed.

47. A spray gun according to claim 43 wherein said front partition of said valve element has a nose projecting away from the hollow interior of the valve element, said nose in the closed position being positioned within the interior of said spray nozzle and operable to be retracted with movement of said valve element towards said open position.

48. A spray gun according to claim 43 wherein said outlet is in said interior axial wall and is in communication with the hollow interior of said valve element continually as said valve element is displaced axially of said tubular bore between the closed position and the open position.

49. A spray gun according to claim 48 wherein the valve element has an axial peripheral shell, said gun including a transverse stator surface fixedly mounted relative to said outlet within said hollow interior, said transverse stator surface having a flare merging into the axial interior surface of the shell of said valve element.

50. spray gun according to claim 43 wherein the valve element has a peripheral shell and a rear transverse partition at the opposite axial end of said hollow interior of the valve element, the inwardly-facing surfaces of said forward and rear transverse partitions being flared into the hollow interior of said peripheral shell so as to provide a streamlined flow path for fluent material flowing through said hollow interior.

51. A spray gun for spraying fluent materials which have a high concentration of abrasive components and/or embodying a high particulate content, said gun comprising:

a valve chamber, a spray nozzle connected to said chamber at one end thereof, a fluent material outlet at the other end of said chamber, and an inlet intermediate said nozzle and said outlet for receiving said fluent material under pressure;

a valve element displaceable in said chamber between a closed and an open position, said valve element having a hollow interior operable in the closed position to extend between said inlet and said outlet and being in fluid communication with both said inlet and said outlet, said inlet and said outlet and said hollow interior of the valve element each having a flow passage affording flow of said fluent material through said inlet into said hollow interior of the valve element and out through said outlet;

said valve element in the open position operable to split the flow through the inlet into a first partial flow through the hollow interior of the valve element and through said outlet, and a second partial flow through the spray nozzle, whereby the flow through said outlet is uninterrupted when said inlet is receiving said fluent material under pressure;

the flow passages of said inlet, said hollow interior of the valve element, and said outlet all providing substantially the same flow area.

52. A spray gun for spraying materials with a particulate content comprising particles having a thickness greater than a given dimension, said gun comprising:

a valve chamber, a spray nozzle connected to said chamber at one end thereof, a material outlet at the other end of said chamber, and an inlet intermediate said nozzle and said outlet for receiving the material under pressure;

a valve element displaceable in said chamber between a closed and an open position, said valve element having a hollow interior operable in the closed position to extend between said inlet and said outlet and being in fluid communication with both said inlet and said outlet, said inlet and said outlet and said hollow interior of the valve element each having a flow passage affording flow of said spraying materials through said inlet, said hollow interior of the valve element and out through said outlet;

said valve element in the open position operable to split the flow through the inlet into a first partial flow through the hollow interior of the valve element and through said outlet, and a second partial flow through the spray nozzle, whereby the flow through said outlet is uninterrupted when said inlet is receiving said spraying materials under pressure;

said valve element having a clearance space within said valve chamber which is no greater than said given dimension and being displaceably mounted in said chamber without seals or packings.

* * * * *

UNITED STATES PATENT AND TRADEMARK OFFICE

CERTIFICATE OF CORRECTION

PATENT NO. : 5,553,788

DATED : September 10, 1996

INVENTOR : Peter V. Del Gaone et al.

It is certified that errors appear in the above-identified patent and that said Letters Patent is hereby corrected as shown below:

Column 2, at 37, "spaying" should be --spraying--;

Column 4, at 45, "shown" should be --showing--;

at 48, "parts" should be --ports--;

at 49, delete "as seen from the line 26-26" and insert --is an enlarged fragmentary view similar to Fig. 21,--;

Column 5, at 50, "stein" should be --stem--;

Column 6, at 15, after "from" insert --maximum forward flow--;

at 16, after "position" insert --at--;

Column 10, at 31 and 32, should read: --18A and 19A, the nozzle 480 has an axial bore 421 whose discharge end 484 is outwardly flared at an included angle of--.

Signed and Sealed this

Eighth Day of April, 1997

*Attest:*

Bruce Lehman

BRUCE LEHMAN

*Attesting Officer*

*Commissioner of Patents and Trademarks*